US011731138B2

(12) United States Patent
Lurk

(10) Patent No.: US 11,731,138 B2
(45) Date of Patent: Aug. 22, 2023

(54) VERTICAL ROLLER MILL SEGMENTED BULL RING AND CLAMPING SYSTEM

(71) Applicant: Williams Patent Crusher and Pulverizer Company, St. Louis, MO (US)

(72) Inventor: David Lurk, Red Bud, IL (US)

(73) Assignee: WILLIAMS PATENT CRUSHER AND PULVERIZER COMPANY, St. Louis, MO (US)

( * ) Notice: Subject to any disclaimer, the term of this patent is extended or adjusted under 35 U.S.C. 154(b) by 79 days.

(21) Appl. No.: 17/410,111

(22) Filed: Aug. 24, 2021

(65) Prior Publication Data

US 2022/0055037 A1 Feb. 24, 2022

Related U.S. Application Data

(60) Provisional application No. 63/069,360, filed on Aug. 24, 2020.

(51) Int. Cl.
*B02C 15/02* (2006.01)
*B02C 15/00* (2006.01)

(52) U.S. Cl.
CPC ..... *B02C 15/02* (2013.01)

(58) Field of Classification Search
CPC ..... B02C 15/02; B02C 15/003
(Continued)

(56) References Cited

U.S. PATENT DOCUMENTS 703,542 A * 7/1902 Calrk ..... B02C 15/02 241/129
1,781,572 A * 11/1930 Drummond ..... B02C 15/02 241/58

(Continued)

FOREIGN PATENT DOCUMENTS

CN 103521309 A * 1/2014
CN 108435337 A * 8/2018 ..... B02C 15/02

(Continued)

OTHER PUBLICATIONS

English translate (CN108435337A), retrieved date Dec. 21, 2022.*

(Continued)

*Primary Examiner* — Matthew Katcoff
*Assistant Examiner* — Mohammed S. Alawadi
(74) *Attorney, Agent, or Firm* — Sandberg Phoenix von Gontard PC

(57) ABSTRACT

A vertical roller mill with segmented bull ring and clamping system includes a roller mill base having an internal taper configured for holding a bull ring in grinding position, a cowring dimensioned to be fitted into the internal taper of the base and a clamp ring secured atop the cowring. Each of these has a plurality of apertures spaced and configured so that when fastened together with fasteners, they form a radial landing platform for a plurality of segmented bull ring bricks. The system also includes a plurality of segmented bull ring bricks which, when clamped to the radial landing platform and taken as a whole, form a solid, but readily separable, segmented bull ring suitable for use in a roller mill. The system further includes wedge blocks and fasteners for individually removably clamping the segmented bull ring bricks to the radial landing platform.

3 Claims, 4 Drawing Sheets

(58) Field of Classification Search
USPC ..... 241/129, 131
See application file for complete search history.

(56) References Cited

U.S. PATENT DOCUMENTS 2,192,310 A * 3/1940 Hartshorn ..... B02C 15/16 188/185
2,506,499 A * 5/1950 Gibson ..... B02C 15/02 241/129
2,765,123 A * 10/1956 Speer ..... B02C 15/02 241/58
3,337,142 A * 8/1967 Williams ..... B02C 15/02 241/130
3,785,576 A * 1/1974 Desbordes ..... B02C 15/02 241/57
4,022,387 A * 5/1977 Williams ..... B02C 15/02 241/130
4,522,343 A * 6/1985 Williams ..... B02C 15/001 241/110
4,524,917 A * 6/1985 Williams ..... B02C 15/02 241/129
4,830,290 A * 5/1989 Williams ..... B02C 15/02 548/216
6,446,888 B1 * 9/2002 Williams, Sr. ..... B02C 15/001 241/80
7,963,471 B2 * 6/2011 Chen ..... B02C 15/02 241/129
9,289,772 B2 * 3/2016 Storm ..... B02C 15/003
9,636,683 B2 * 5/2017 Tallent ..... B02C 15/003
2015/0034746 A1 * 2/2015 Storm ..... B02C 15/003 241/47

FOREIGN PATENT DOCUMENTS

FR 627130 A * 9/1927
WO WO-2017043939 A1 * 3/2017 ..... B02C 15/00

OTHER PUBLICATIONS

English translate (CN103521309A), retrieved date Dec. 21, 2022.*
English translate (FR627130A), retrieved date Dec. 21, 2022.*
English translate (WO2017043939A1), retrieved date Dec. 21, 2022.*

* cited by examiner

VERTICAL ROLLER MILL SEGMENTED BULL RING AND CLAMPING SYSTEM

CROSS-REFERENCE TO RELATED APPLICATIONS

This application claims priority to U.S. Provisional Application No. 63/069,360, filed on Aug. 24, 2020, which is herein incorporated by reference in its entirety.

STATEMENT REGARDING FEDERALLY SPONSORED RESEARCH

Not Applicable.

BACKGROUND OF THE DISCLOSURE

The present disclosure relates to vertical roller mills and systems including bull ring components. In particular, the invention relates to segmented bull rings with clamping mechanisms useful for replacing standard one-piece bull rings in such vertical roller mills.

Current roller mill ring apparatus of this type utilize a large one-piece bull ring as part of the grinding structure that fits inside the grinding chamber of the roller mill. To replace or substantially repair the bull ring of such standard one-piece systems, large heavy duty lifting equipment needs to be employed to lift out the bull ring from the mill. Additionally, it typically requires the removal of a substantial exterior portion of the roller mill in order to facilitate the removal of the bull ring when facing the need for its replacement or repair.

It would be advantageous, therefor, if a system could be developed to replace such conventional, very heavy one-piece bull rings in vertical roller mills so that the need for large lifting and removal equipment and the dismantling of sections of the roller mill for removal of the entire one-piece bull ring could be avoided. This would especially be useful if a modified bull ring system could be devised to overcome these deficiencies without the need for making any other modifications to the roller mill itself. Further, such a system would be particularly advantageous as the bull ring is a significant wear part in the roller mill during normal operations, and thus, avoiding its removal for any extended period for repair or replacement would avoid or minimize one of the more common causes of down time of the entire roller mill operation over such an extended shut-down period.

SUMMARY OF THE INVENTION

Accordingly, applicant has developed a system, apparatus and method to overcome the above deficiencies of one-piece bull ring systems and provide additional advantages as stated herein.

In one aspect, a segmented bull ring apparatus and system includes a ring including multiple wedge-shaped pieces, i.e., bull ring segments, in place of a single unitary ring. This plurality of wedge-shaped sections is configured to be secured and joined together to form such a grinding ring. These fit inside the grinding chamber of a roller mill. When completed, the segments take the shape of a solid ring held in place in the grinding chamber by a clamping mechanism such as tensioning bolts and wedge blocks as described herein.

In another aspect, a vertical roller mill with segmented bull ring apparatus and clamping system includes a cowring with apertures for alignment with corresponding apertures in a roller mill base. The base preferably has an internal taper for holding a bull ring in place. Also preferably included is a clamp ring secured to the cowring which together, form a radial landing platform for bull ring brick segments. The bull ring brick segments are generally wedge-shaped and taken as a whole form a solid bull ring when placed together and clamped onto the landing platform, such as with wedge blocks which, together with fasteners, clamp the segmented bull ring securely into the solid bull ring.

In another aspect, a method for installing a segmented bull ring apparatus or portions thereof is provided. The method provides for installation or replacement of the segmented bull ring apparatus or parts thereof using as few as one or two personnel employing only small hand tools such as wrenches and the like, therefore eliminating the need for large lifting equipment and avoiding or minimizing significant down-time. In the method, a roller mill in which the prior art one-piece bull ring has been removed, or in which no bull ring is present, presents the roller mill's base. Typically, and preferably, the base is machined or otherwise configured with an internal taper to aide in holding a bull ring in place, as per the standard roller mill. In the method of this aspect, a cowring containing keyway sections is placed into the taper of the roller mill base and inserted and locked into place using fasteners. The method further involves the step of placing a clamp ring onto the cowring while aligning apertures in the cowring with apertures in the roller mill base and securing the clamp ring to the roller mill base using a securing device, and securing the roller mill base to the cowring with additional fasteners. The combination of the clamp ring and cowring secured to the roller mill base creates a radial landing platform for bull ring brick segments to be placed in, creating a segmented bull ring when the bull ring brick segments are set into the radial landing platform, thereby creating a complete ring. When the ring is nearly complete, the method further includes the step of placing the last bull ring brick segment axially into place in the ring before clamping. Once all of the bull ring brick segments are in place, wedge blocks and multiple wedge blocks are installed with locking devices to retain the segmented bull ring apparatus in place. The method involves placement and securing multiple wedge blocks in the sections below the keyway sections in the cowring to ensure that a clamping force is placed on the bull ring brick segments at each of the keyway sections In another aspect, a method is provided for replacing or installing individual segments of a segmented bull ring from a roller mill system. In the method a notch is located radially in the clamp ring. A multiple wedge block secured to the clamp ring is first removed, thus freeing the bull ring segment which can then be removed by sliding it vertically through the notch. Wedge blocks of interest and bull ring segments of interest can then be removed by tilting them forward or sliding them radially to the nearest notch. Replacement bricks or wedge blocks may be installed by reversing the above procedures.

The present disclosure also includes methods for repairing a segment of a bull ring or other portion of the segmented bull ring apparatus, by removing the segment(s) or other part(s), repairing them, and reinserting them into the segmented bull ring bull ring apparatus generally as outlined above.

BRIEF DESCRIPTION OF THE DRAWINGS

The presently disclosed subject matter will be better understood from reading the following description of non-limiting embodiments, with reference to the attached drawings, wherein below.

DESCRIPTION OF THE PREFERRED EMBODIMENT

Figure 1:
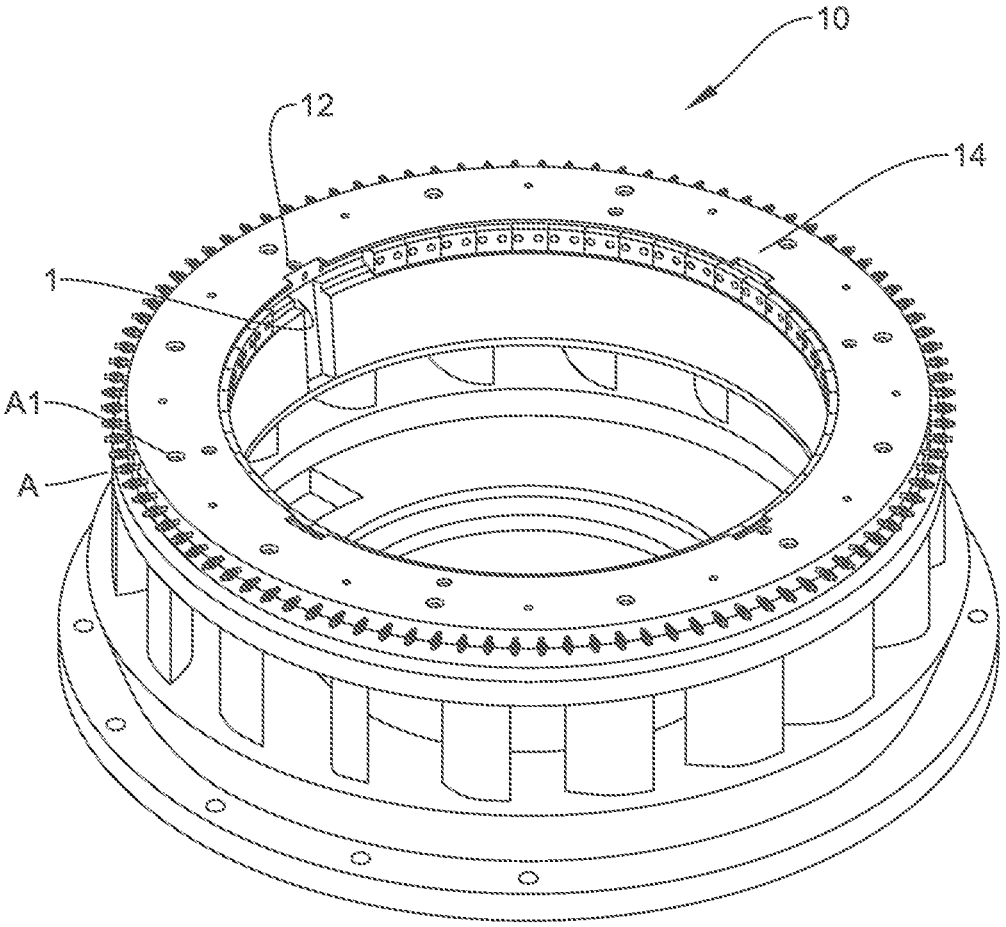
FIG. 1 is a schematic top perspective depiction of an illustration of an embodiment of a segmented bull ring and clamping system according to the invention in place within a roller mill, in which a last bull ring brick segment remains to be placed axially into a remaining space in the bull ring before clamping.

The foregoing summary, as well as the following description illustrates the disclosure by way of example and not by way of limitation. Additionally, it is to be understood that the disclosure is not limited in its application to the details of construction and the arrangements of components set forth in the following description or illustrated in the drawings. The disclosure is capable of other embodiments and of being practiced or being carried out in various ways. Also, it is to be understood that the phraseology and terminology used herein is for the purpose of description and should not be regarded as limiting.

Figure 2:
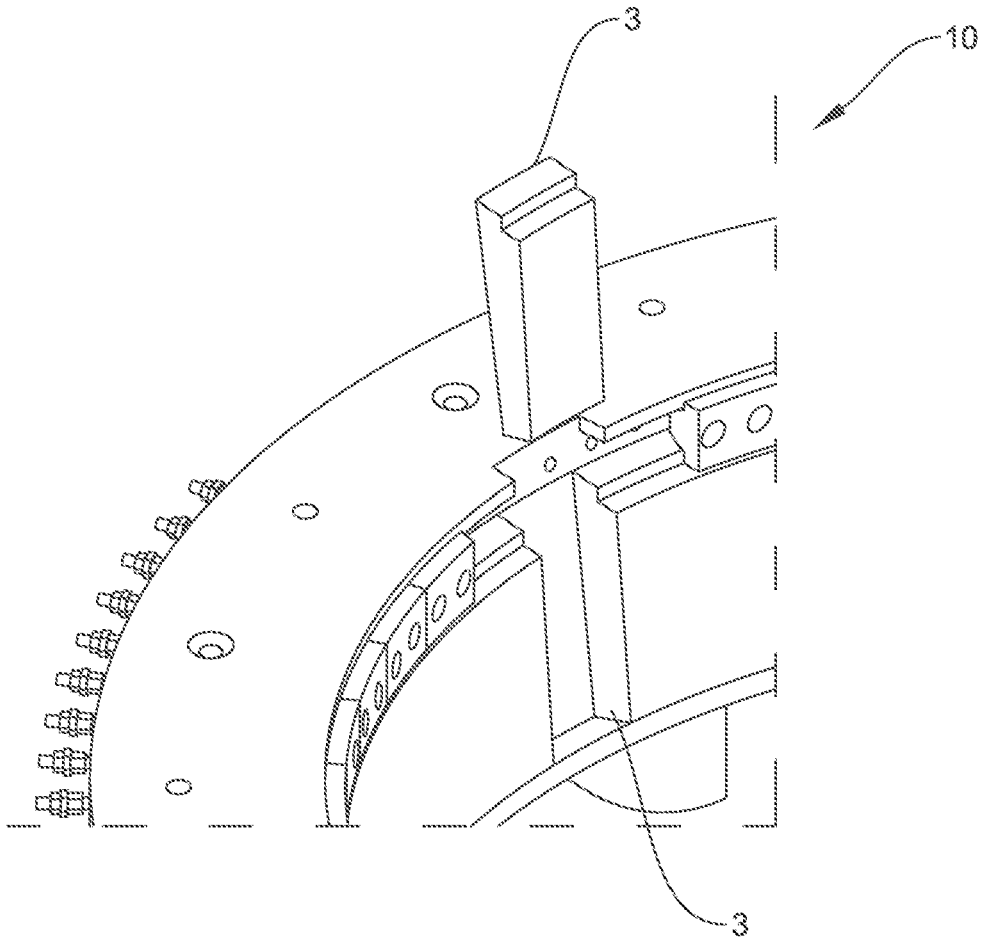
FIG. 2 is an enlarged schematic top perspective depiction of an illustrative portion of the embodiment of the segmented bull ring and clamping system of FIG. 1, in which the separate brick segments are clearly visible and the last bull ring brick segment is ready to be placed axially into place before clamping.
Figure 3:
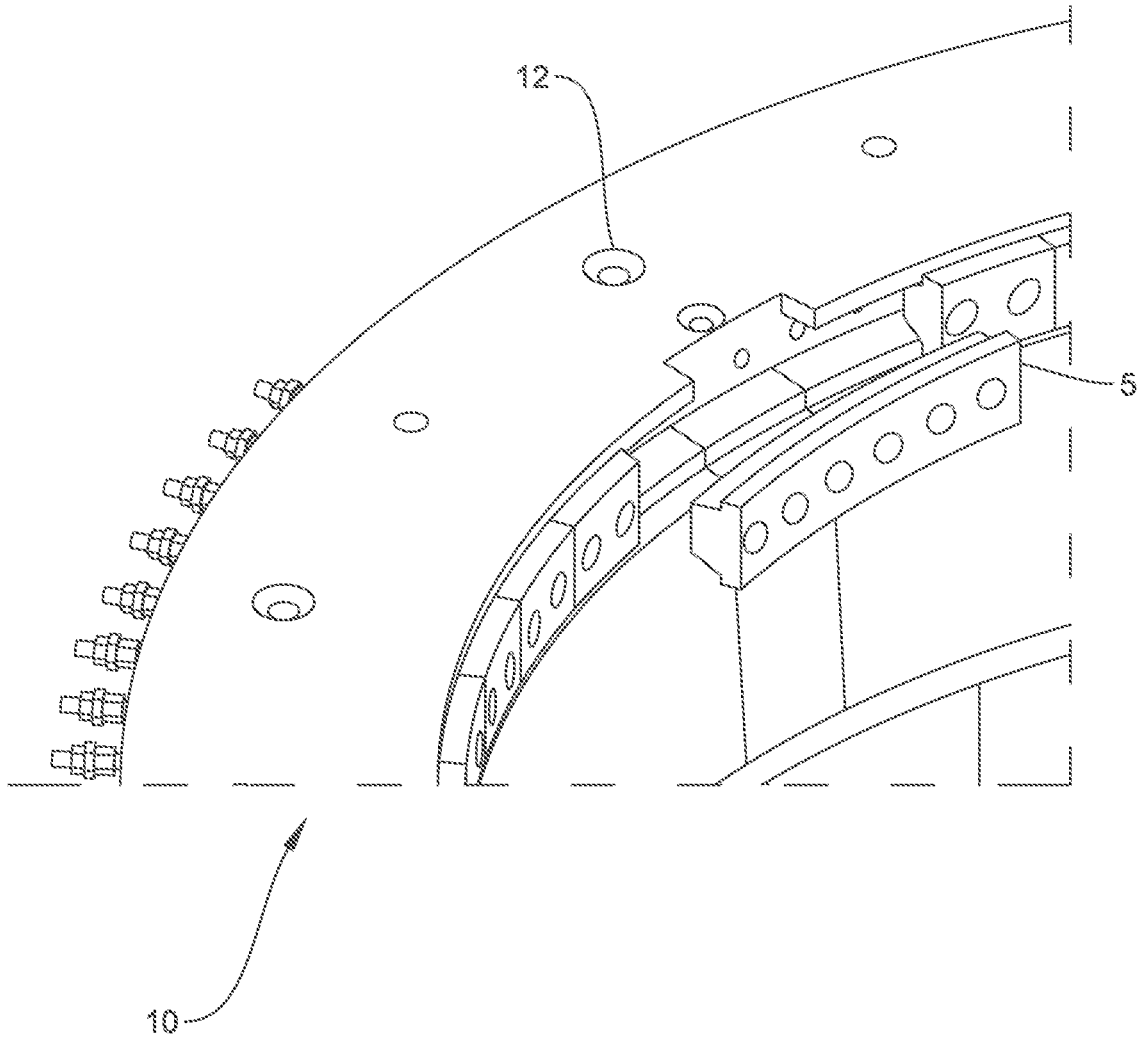
FIG. 3 is an enlarged schematic top perspective depiction of an illustrative portion of an embodiment of the segmented bull ring and clamping system of FIG. 2, in which a triple wedge block is also ready to be placed axially into place before clamping.
Figure 4:
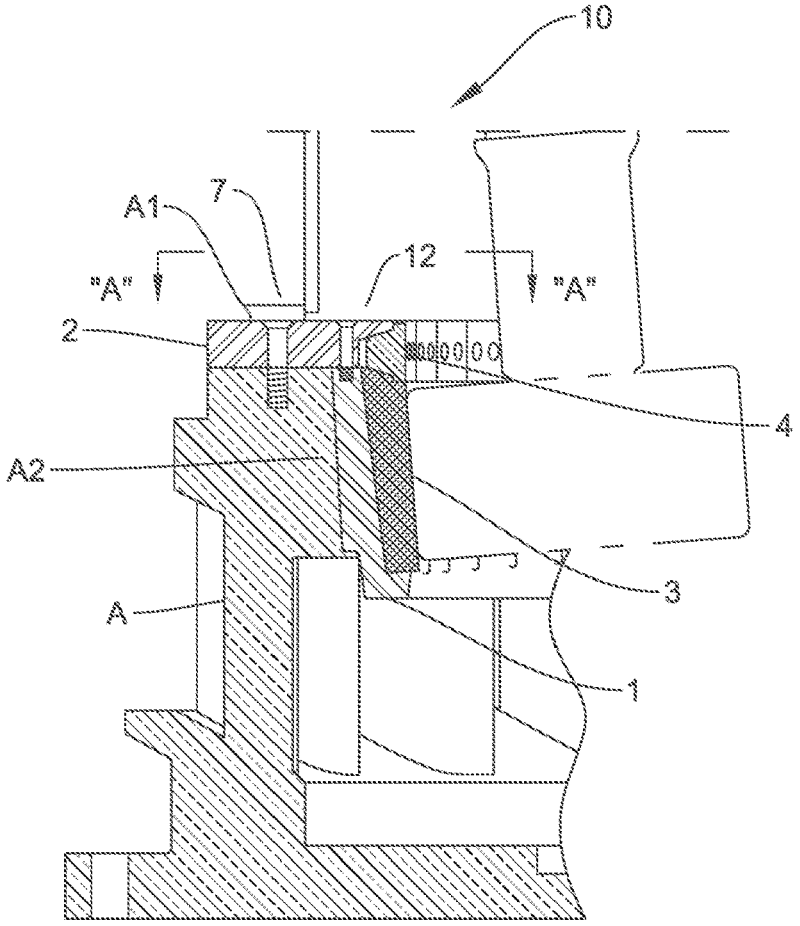
FIG. 4 is a cross-section taken of a typical section of a segmented bull ring apparatus according to an embodiment of the invention.
Figure 5:
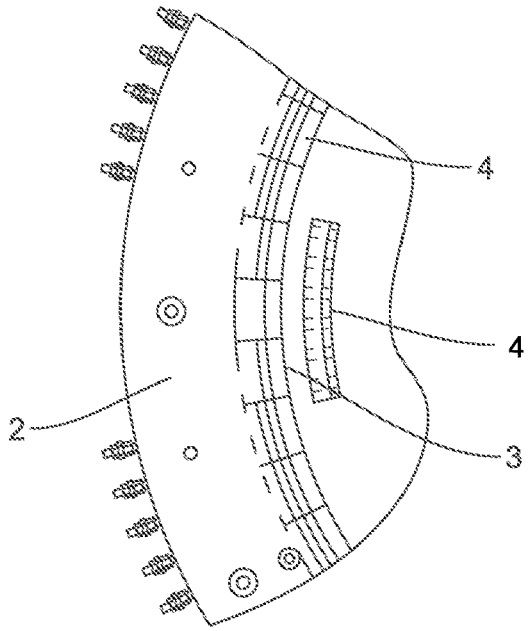
FIG. 5 is a portion of the cross-section of FIG. 4 shown along View "A-A" of the same cross-section figure

As discussed above, in a standard prior art roller grinding mill apparatus, (see, e.g., that disclosed in U.S. Pat. No. 4,022,387, incorporated herein by reference), a large, one-piece "bull ring" in a stationary setting is used as part of the roller mill grinding operation. See, e.g., Col. 2, lines 66-68: the "bull ring (#39 in FIGS. 1-3), is fixed in a tapered seat in the frame 10 and presents an inward grinding face 39 to the rollers." The present invention is designed to replace this standard one-piece bull ring with a modular system which allows for much easier handling, especially, e.g., in situations requiring replacement or repair of at least a section of the bull ring.

Referring to FIGS. 1-5 described above, a segmented bull ring and clamping system 10 for a roller mill apparatus includes a cowring 1 with apertures 12 for alignment with corresponding apertures A1 in the roller mill base A. The roller mill base A (whether one originally for holding the prior art one-piece bull ring or one designed specifically for the segmented bull ring/clamping system 10 of the present invention) typically and preferably will have an internal taper A2 machined to a dimension to facilitate holding the bull ring (see, e.g., item #39 of the '387 patent) in place. The cowring 1 of the present invention, as the part of the segmented bull ring/clamping system 10 abutting the roller mill base A is also configured to be fitted into the internal taper A2 of the roller mill base A and thereafter locked into place. Both of the roller mill base A, and the cowring 1, have apertures which are spaced and configured to align so that they can be secured together using, e.g., dowel pins. Also included is a clamp ring 2 used to assist in securing the cowring 1 to the roller mill base A. In one embodiment, the clamp ring 2 is placed on the cowring 1 while aligning twelve countersunk holes in the cowring 1 with twelve of twenty-four threaded holes in the roll mill base A. The clamp ring 2 is secured to the roller mill base A with twelve counter sunk bolts 7 or other fasteners, and then to the cowring 1 with six counter sunk bolts 12 or other fasteners. See FIGS. 4-5.

With the clamp ring 2 and cowring 1 secured to the roller mill base, a radial landing platform is created for placement of the bull ring brick segments 3. The bull ring brick segments 3 are thus joined together to form a solid, but modular (segmented), bull ring when placed in a ring formation and clamped onto the above-described landing platform. The bull ring brick segments 3 are clamped together using wedge blocks 4, and multiple, in this embodiment, triple, wedge blocks 4 which, together with fasteners, clamp the segmented bull ring securely into a solid bull ring. Thus, each brick segment 3 can be readily added to or removed from the ring for repair or replacement, as described herein.

The segmented bull ring and clamping apparatus can be used to replace a standard large one-piece bull ring in a roller mill system and accrue the benefits and improvements of a segmented system such as eliminating the need for using heavy lifting equipment and power tools. The segmented roller mill bull ring can replace the wear surface of the one-piece bull ring with one which is segmented in a modular fashion and can be accessed using a small, normal access door included in the roller mill cover and using just small hand tools.

Additionally, once installed, the segmented bull ring and clamping system provides an ongoing method for installing, repairing, and replacing a segmented bull ring apparatus and any of its parts much more easily, thus avoiding or minimizing significant down-time for mill operators. For installation, the segmented bull ring and clamping system can be placed in service by exposing a roller mill base preferably with an internal taper machined in the base to hold a bull ring in place. The construction of the segmented bull ring and clamping system 10 is then fully installed as previously generally described. A cowring 1 containing keyway sections 14 is placed into the taper A2 of the roller mill base A and inserted and locked into place using fasteners such as tensioning bolts 7. Preferably, the method further involves the step of placing a clamp ring 2 onto the cowring 1 while aligning apertures in the cowring with apertures in the roller mill base A and securing the clamp ring 2 to the roller mill base A using a securing device such as tensioning bolts 7, and securing the roller mill base A to the cowring 1 with additional fasteners. The combination of the clamp ring 2 and cowring 1 secured to the roller mill base A creates a radial landing platform for the bull ring brick segments 3 to be placed in, thereby forming a solid, but segmented, bull ring when the bull ring brick segments are all set into the radial landing platform. When the ring is nearly complete, in a preferred embodiment, the method can further include placing a final bull ring brick segment axially into place in the ring before clamping. Once all of the bull ring brick segments are in place, in this embodiment, unit wedge blocks and triple wedge blocks are installed with locking devices 7 to retain the segmented bull ring apparatus 10 in place. Preferably the triple wedge blocks 5 are placed and secured with locking bolts and nuts (not shown) in, e.g., locations below each keyway section 8 in the cowring 1 to ensure that a clamping force is placed on the bull ring brick segments at each of, e.g., four keyway sections.

A large one-piece bull-ring can also be retrofitted to a segmented bull-ring system utilizing the methodology and principles as describe herein.

Alternatives can be provided with regard to various components of the segmented bull ring and clamping system, apparatus and methods as described above regarding certain embodiments, and others will be introduced as new embodiments are introduced. For example, the material used to construct the segmented bull ring material could be upgraded to a ceramic/alloy matrix for longer wear, e.g., to match that of the grinding roll In view of the above, it will be seen that the several objects of the invention are achieved, and other advantageous results are obtained. As various changes could be made in the above constructions without departing from the scope of the disclosure, it is intended that all matter contained in the above description or shown in the accompanying drawings shall be interpreted as illustrative and not in a limiting sense.

What is claimed is:

1. A segmented bull ring apparatus and clamping system comprising:

a plurality of bull ring bricks configured to be removably clamped together to form a solid grinding ring, the ring having a grinding surface suitable for grinding use in a roller mill, each of the plurality of bull ring bricks having an outer radial side, an inner radial side, and first and second lateral sides;

the segmented bull ring apparatus and clamping system comprising a radial landing platform for placement of the outer radial surface of each of the plurality of bull ring bricks in abutment to the radial landing platform, a plurality of wedge blocks in abutment to the inner radial surface of each of the plurality of bull ring bricks, and fasteners for removably holding together the platform, the plurality of bull ring bricks and the plurality of wedge blocks together as a solid bull ring apparatus when the plurality of bull ring bricks are placed so that the first and second lateral side of each brick is placed in abutment to another of the plurality of bull ring bricks, thereby forming a solid, but segmented bull ring apparatus.

2. A vertical roller mill with segmented bull ring and clamping system comprising:

a roller mill base having an internal taper configured for holding a bull ring in grinding position;

a cowring dimensioned to be fitted into the internal taper of the roller mill base; and, a clamp ring secured atop the cowring; each of the roller mill base, the cowring and the clamp ring having a plurality of apertures spaced and configured so that when fastened together with a plurality of fasteners, as a unit they form a radial landing platform for a plurality of segmented bull ring bricks;

a plurality of segmented bull ring bricks which, when clamped to the radial landing platform and taken as a whole, form a solid, but readily separable, segmented bull ring suitable for use in a roller mill;

and wedge blocks and fasteners for individually removably clamping the segmented bull ring bricks to the radial landing platform.

3. A method of installing a segmented bull ring and clamping system into a vertical roller mill, the method comprising the steps of obtaining a segmented bull ring apparatus and clamping system comprising:

a plurality of bull ring bricks configured to be removably clamped together to form a solid grinding ring, the ring having a heft and grinding surface suitable for grinding use in a roller mill, each of the plurality of bull ring bricks having an outer radial side, an inner radial side, and first and second lateral sides;

the segmented bull ring apparatus and clamping system further comprising a radial landing platform for placement of the outer radial surface of each of the plurality of bull ring bricks in abutment to the radial landing platform, a plurality of wedge blocks in abutment to the inner radial surface of each of the plurality of bull ring bricks, and fasteners for removably holding together the platform, the plurality of bull ring bricks and the plurality of wedge blocks together as a solid bull ring apparatus when the plurality of bull ring bricks are placed so that the first and second lateral side of each brick is placed in abutment to another of the plurality of bull ring bricks, thereby forming a solid, but segmented bull ring apparatus; and, placing the segmented bull ring and clamping system or an individual bull ring brick or other portion thereof into the vertical roller mill, the vertical roller mill comprising:

a roller mill base having an internal taper configured for holding a bull ring in grinding position;

a cowring dimensioned to be fitted into the internal taper of the roller mill base; and, a clamp ring secured atop the cowring; each of the roller mill base, the cowring and the clamp ring having a plurality of apertures spaced and configured so that when fastened together with a plurality of fasteners, as a unit they form a radial landing platform for a plurality of segmented bull ring bricks;

a plurality of segmented bull ring bricks which, when clamped to the radial landing platform and taken as a whole, form a solid, but readily separable, segmented bull ring suitable for use in a roller mill;

and the plurality of wedge blocks and fasteners for individually removably clamping the segmented bull ring bricks to the radial landing platform.

* * * * *